US006935871B2

(12) United States Patent
Maurer, Jr.

(10) Patent No.: US 6,935,871 B2
(45) Date of Patent: Aug. 30, 2005

(54) ELECTRICAL CORD PLUG LOCK

(75) Inventor: Michael Maurer, Jr., 19231 Brook Hollow Dr., Wildwood, MO (US) 63038

(73) Assignee: Michael Maurer, Jr., Wildwood, MO (US)

( * ) Notice: Subject to any disclaimer, the term of this patent is extended or adjusted under 35 U.S.C. 154(b) by 0 days.

(21) Appl. No.: 10/709,418

(22) Filed: May 4, 2004

(65) Prior Publication Data

US 2004/0224543 A1 Nov. 11, 2004

Related U.S. Application Data

(60) Provisional application No. 60/320,178, filed on May 8, 2003.

(51) Int. Cl.[7] ..... H01R 13/44

(52) U.S. Cl. ..... 439/133; 439/304; 439/134; 70/53; 70/57

(58) Field of Search ..... 439/133, 134, 439/304; 70/53, 57

(56) References Cited

U.S. PATENT DOCUMENTS

| | | | | | |
|---|---|---|---|---|---|
| 3,345,600 | A | * | 10/1967 | Scherer | 439/134 |
| 3,539,968 | A | * | 11/1970 | Wegner et al. | 439/134 |
| 4,204,723 | A | * | 5/1980 | Bloomingdale | 439/135 |
| 4,308,730 | A | * | 1/1982 | Roth | 439/134 |
| 4,407,554 | A | * | 10/1983 | Drall | 439/133 |
| 4,413,488 | A | * | 11/1983 | Harmison, Jr. | 439/133 |
| 4,488,764 | A | | 12/1984 | Pfenning et al. | |
| 4,563,048 | A | | 1/1986 | Im | |
| 4,566,297 | A | | 1/1986 | Hawley | |
| 4,666,224 | A | | 5/1987 | Fields | |
| 4,673,230 | A | | 6/1987 | Baumgart | |
| 4,957,446 | A | * | 9/1990 | Belsky | 439/134 |
| 4,969,833 | A | * | 11/1990 | Lindow et al. | 439/133 |
| 5,288,239 | A | * | 2/1994 | Johnson | 439/134 |
| 5,666,829 | A | | 9/1997 | Aikens | |
| 5,795,166 | A | | 8/1998 | Meixler | |
| 5,848,905 | A | | 12/1998 | Patel | |
| D404,635 | S | | 1/1999 | Yang | |
| 6,082,155 | A | | 7/2000 | Su | |
| 6,159,025 | A | | 12/2000 | Derman | |
| 6,363,758 | B1 | | 4/2002 | Ling | |
| 6,415,634 | B2 | | 7/2002 | Luquire | |
| 6,513,356 | B1 | | 2/2003 | Yang | |
| D472,789 | S | | 4/2003 | Ling | |
| D476,547 | S | | 7/2003 | Ling | |
| D477,525 | S | | 7/2003 | Ling | |
| 6,598,434 | B2 | | 7/2003 | Yang | |
| 6,652,307 | B2 | * | 11/2003 | Tatz | 439/134 |
| 6,675,614 | B2 | | 1/2004 | Lai | |

OTHER PUBLICATIONS

Sellery, Inc., Combination Padlock, California, digital photograph of item taken Nov. 7, 2003.

* cited by examiner

*Primary Examiner*—Tho D. Ta
(74) *Attorney, Agent, or Firm*—Blackwell Sanders Peper Martin LLP

(57) ABSTRACT

A locking device for use with an electrical plug having a pair of spaced prongs, each prong having an aperture spaced from its free end portion, the locking device including a body member, a pair of spaced apart arm members, and an elongated member extending between the pair of arm members. The transverse member is adapted for insertably receiving the apertures associated with the plug prongs, one of the arm members being pivotally movable between a first position wherein sufficient space is provided for engaging the plug apertures with the free end portion of the elongated member and a second position wherein the plug prongs cannot be disengaged from the elongated member. The locking device includes a locking mechanism for selectively holding the movable arm member in its second position and the arm members are appropriately sized and shaped such that the terminal end portions of the plug prongs cannot be maneuvered into any orientation while engaged with the elongated member so as to extend beyond the periphery of the arm members.

12 Claims, 2 Drawing Sheets

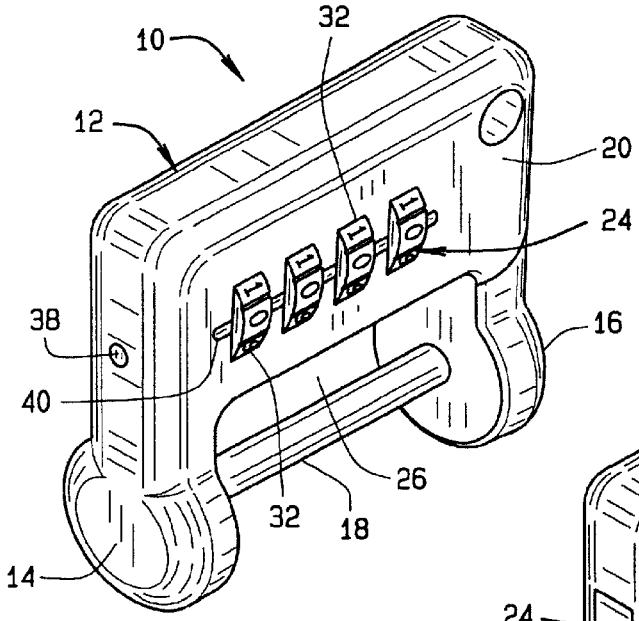
FIG. 1
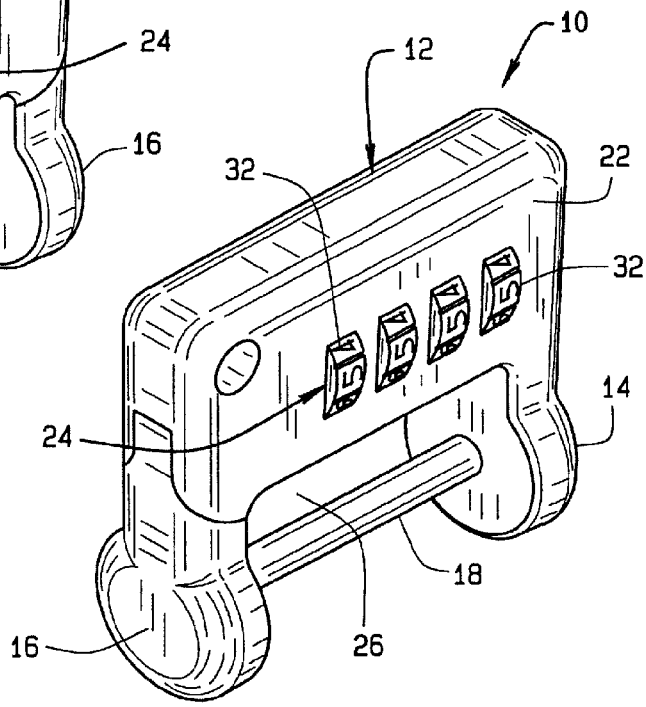
FIG. 2
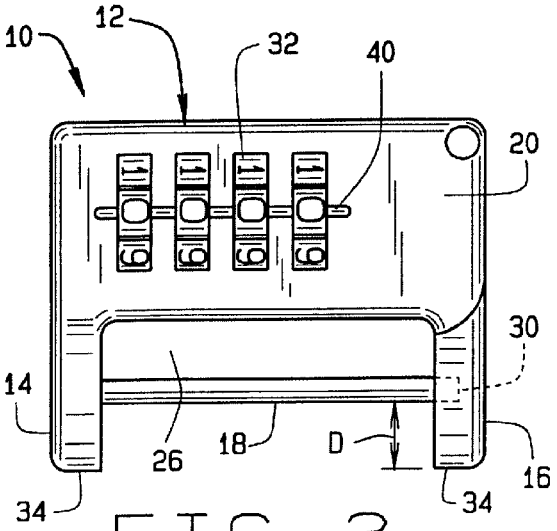
FIG. 3
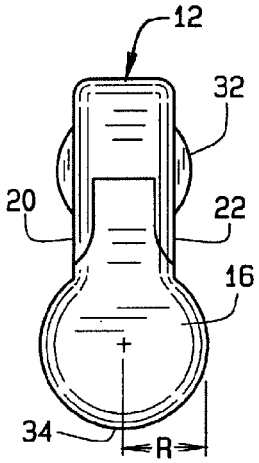
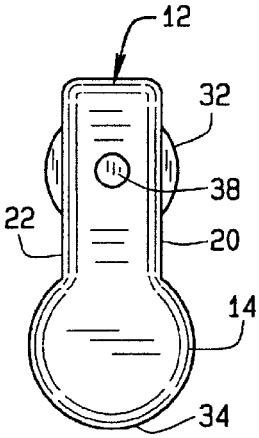
FIG. 5
FIG. 4

ELECTRICAL CORD PLUG LOCK

CROSS REFERENCE TO RELATED APPLICATIONS

This application claims the benefit of U.S. Provisional Application Ser. No. 60/320,178 filed May 8, 2003.

BACKGROUND OF INVENTION

The present invention relates generally to the field of devices designed to prevent the unauthorized use of electrically powered devices and, more particularly, to a locking device which engages both prongs of an electrical plug and prevents such prongs from being inserted into an electrical outlet.

For personal and/or safety reasons, it is often desirable to prohibit the use of certain electrically operated devices. For example, with potentially dangerous power tools and/or other electrical appliances such as electric table saws, electric hand saws, power drills, toasters, irons and so forth, it is desirable to prevent children or other unauthorized individuals from using such tools and/or appliances so as to avoid potential injury to the user, potential property damage, and/or potential fire hazard. Various types of locks and other mechanisms for use with electrically powered devices, electrical appliances and other equipment for preventing unauthorized use a re well known in the art. Such locking devices are also widely used by parents to restrict use of certain types of equipment such as televisions, radios, computers, VCRs, stereos, electronic games and so forth.

Many of the prior art safety/locking type plug devices are complex to use and expensive to manufacture. For example, some devices render the entire plug inaccessible by placing the plug within a locked enclosure. See, for example, U.S. Pat. Nos. 4,488,764; 4,666,224; 4,673,230; and 6,159,025. Other devices operate by securing or clamping a lock to the prongs of the plug using various locking mechanisms. See, for example, U.S. Pat. Nos. 5,666,829 and 5,795,166. Still other devices utilize the insertion of pins, or the shackle of a padlock through the holes in the prongs of a plug, to complete attachment of the locking mechanism. See, for example, U.S. Pat. Nos. 4,563,048; 4,566,279; and 5,848,905. Although some of these locking devices utilize the holes in the prongs of a plug to secure the locking mechanism, many of these devices can be maneuvered and manipulated such that at least a portion of one or both prongs can be inserted into and can make electrical contact with an electrical outlet which can result in an electrical shock or other injury or damage to the user and/or the electrical devices. Still further, other locking devices utilize spring loaded pin members, and some locking devices attach through one of the holes in a prong of a plug, which arrangement can likewise result in an electrical shock if the free prong is inserted into an electrical outlet.

It is therefore desirable to provide a relatively simple and easy to operate locking device which not only prevents unauthorized use of a particular electrical appliance or other electrically powered device, but also prevents inadvertent or partial contact with an electrical outlet when the locking device is properly installed.

Accordingly, the present invention is directed to overcoming one or more of the problems set forth above.

SUMMARY OF INVENTION

The present invention teaches the construction and use of a relatively simple electrical cord plug locking device which engages both prongs of an electrical plug and prohibits such electrical plug from being electrically engaged with an electrical outlet. More particularly, the present plug locking device prevents the insertion of a male electrical plug into an electrical outlet and includes a body member having two spaced apart arm members extending from adjacent one side portion thereof so as to form an open space therebetween. One arm member is fixedly attached to the body member adjacent one end portion thereof and the other arm member is pivotally attached to the body member adjacent the opposite end portion. An elongated transverse member fixedly attached to one of the arm members extends across the space defined between the two arm members and is engageable with the pivotable arm member when in its closed or locked position. The transverse member is sized and shaped so as to be receivably insertable within the apertures associated with the spaced parallel prongs of a typical electrical plug. In this regard, the pivotable arm member is movable between an open position wherein sufficient space is provided for allowing one end portion of the transverse member to be maneuvered through the prong apertures associated with a typical electrical plug and a closed position wherein the pivotable arm member engages the transverse member and prevents the electrical prongs from being disengaged from the transverse member. Once the plug prongs are engaged with the transverse member and the pivotable arm member is moved into its closed position, the electrical plug is captured between the opposed arm members.

The body member associated with the present plug locking device likewise includes a locking mechanism for holding the pivotable arm member in its closed and engaged position with the transverse member. Such locking mechanism can take on a wide variety of different forms including, in a preferred embodiment, a combination lock mechanism wherein any plurality of tumblers can be utilized to define an unlocked position releasing the pivotable arm member for movement to its open position.

The transverse member extending between the two opposed arm members is likewise positioned within the space formed by and between the opposed arm members and the body member such that rotation of the prongs associated with a particular electrical plug when engaged with the transverse member will not, in any position of rotation or orientation about such transverse member, expose the terminal end portions of the prongs beyond the terminal end portions of the opposed arm members. In addition, each of the arm members is likewise sized and dimensioned such that the terminal end portions of the plug prongs will not extend beyond the periphery of such arm members at any maneuverable orientation when engaged with the transverse member. This provides an additional safety feature in that it is physically impossible for the terminal end portions of the plug prongs to be even partially inserted into an electrical outlet.

These and other features and advantages of the present invention will be apparent to those skilled in the art after considering the following detailed specification in conjunction with the accompanying drawings.

BRIEF DESCRIPTION OF DRAWINGS

For a better understanding of the present invention, reference may be made to the accompanying drawings.

FIG. 1 is a front perspective view of one embodiment of the present plug locking device constructed in accordance with the teachings of the present invention.

FIG. 2 is a rear perspective view of the embodiment of the present plug locking device illustrated in FIG. 1.

FIG. 3 is a front elevational view of the plug locking device of FIG. 1.

FIG. 4 is a right side elevational view of the plug locking device of FIG. 1.

FIG. 5 is a left side elevational view of the plug locking device of FIG. 1.

DETAILED DESCRIPTION

Figure 6:
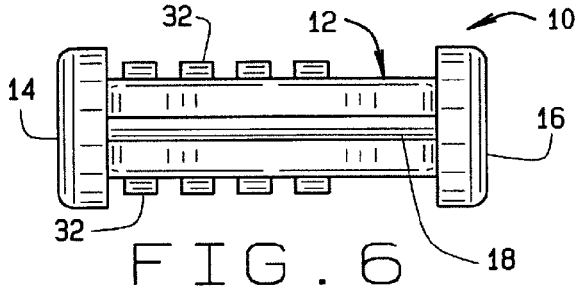
FIG. 6 is a bottom view of the plug locking device of FIG. 1.
Figure 7:
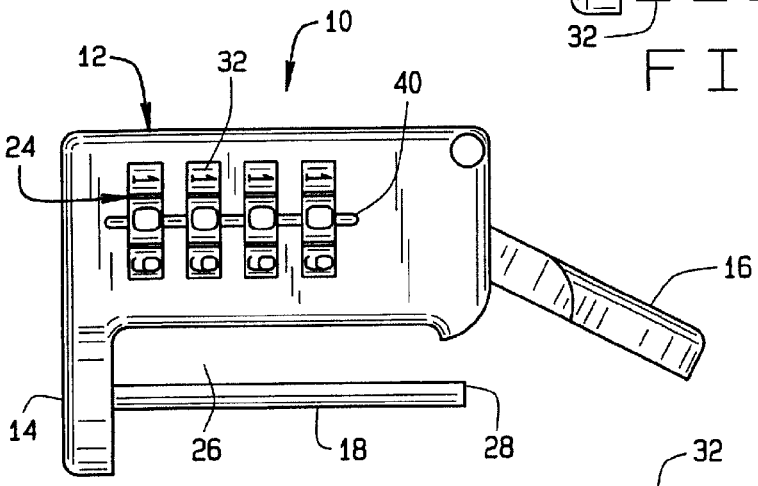
FIG. 7 is a front elevational view of the plug locking device of FIG. 1 showing the pivotable arm member in its open position.

Referring to the drawings more particularly by reference numbers wherein like numerals refer to like parts, number 10 in FIGS. 1 and 2 represents one embodiment of an electrical cord plug locking device constructed in accordance with the teachings of the present invention. The plug locking device 10 includes a body member 12, a pair of arm members 14 and 16, and an elongated transverse member 18 which extends between the arm members 14 and 16. The body member 12 includes front and rear surfaces 20 and 22 respectively and is sized and dimensioned so as to house therewithin a conventional locking system such as the combination lock system 24 as will be hereinafter further explained. The size and shape of the body member 12 may vary depending upon the particular locking mechanism utilized. The arm members 14 and 16 extend outwardly in spaced apart relationship adjacent one side portion of body member 12 so as to form an open space 26 by and between the body member 12 and the spaced apart arm members 14 and 16. One arm member such as the arm member 14 may be fixedly attached to the body member 12 adjacent one end portion thereof as illustrated in FIGS. 1–3, and the other arm member such as arm member 16 is pivotally attached to body member 12 adjacent the opposite end portion as best illustrated in FIG. 7. The fixedly attached arm member such as arm member 14 may be integrally formed with body member 12, or such arm member may be otherwise fixedly attached via any known means. Pivotal arm member 16 is movable between an open position and a closed position as will be hereinafter further explained. It is recognized and anticipated that the pair of arm members 14 and 16 could be positioned and located so as to extend adjacent any side portion of the body member 12 and that either arm member 14 or 16 could be selected as the movable arm member.

Transverse member 18 is likewise fixedly attached to one of the arm members such as non-movable arm member 14 and extends across the space 26 so as to engage the pivotable arm member 16 when arm member 16 is in its closed or locked position. The transverse member 18 is sized and shaped so as to be insertably receivable within the apertures commonly associated with the spaced parallel prongs of a typical electrical plug. Although the size and shape of electrical plugs vary widely, each plug includes a pair of spaced prongs each having an aperture spaced from its respective terminal or free end portion. These apertures are generally uniform, although some variance may exist, and have centers that are aligned along a common axis. Transverse member 18 is therefore sized and shaped so as to receive at least the majority of prong apertures presently in existence. Also, although the transverse member 18 is shown as being substantially cylindrical in shape, it is recognized and anticipated that other shapes may likewise be utilized so long as the transverse member 18 can be insertably received within the prong apertures.

Figure 8:
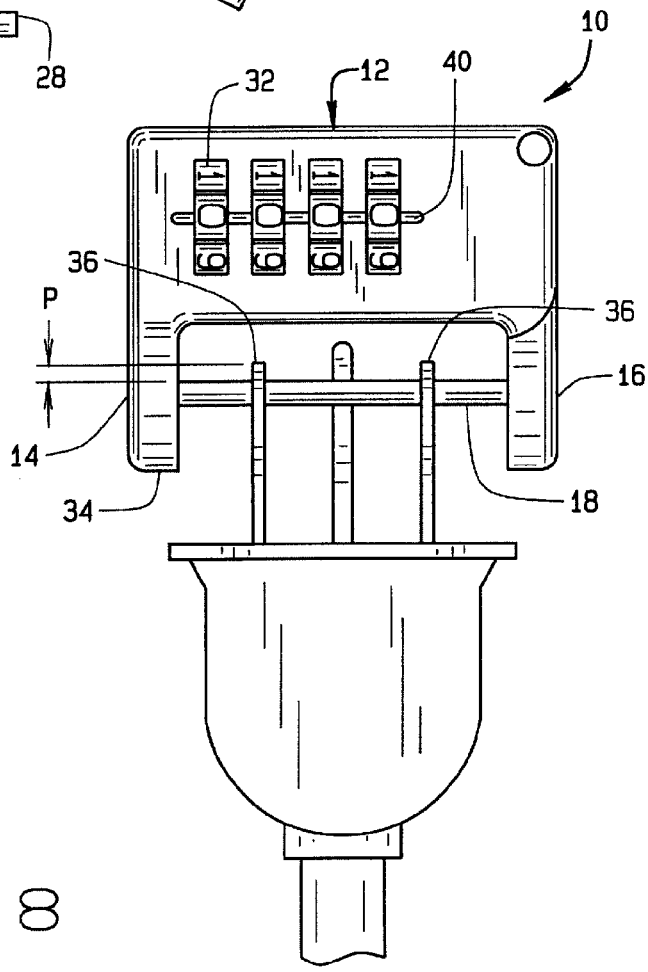
FIG. 8 is a front elevational view showing the plug locking device of FIG. 1 engaged with a typical three prong electrical plug in its closed position.

As best illustrated in FIG. 7, one arm member such as arm member 16 is pivotally movable between an open position as illustrated in FIG. 7 wherein sufficient space is provided adjacent the free end portion 28 of transverse member 18 for allowing the prong apertures associated with a typical electrical plug to be maneuvered into engagement with the transverse member 18, and a closed position wherein the pivotable arm member such as arm member 16 engages the transverse member 18 as best illustrated in FIG. 8 and prevents the member 18 from being withdrawn from the apertures of the plug prongs. In this regard, pivotable arm member 16 includes a cavity or opening 30 as best illustrated in FIG. 3 for receiving the free end portion 28 of transverse member 18 when arm member 16 is moved to its closed position. Once the prongs of a plug are engaged with the transverse member 18 and the pivotable arm member is moved into its closed position, the electrical plug is captured between the opposed arm members 14 and 16 and body member 12 as best illustrated in FIG. 8 and cannot be removed.

Housed within the body member 12 is a locking mechanism such as the combination lock system 24 for holding the pivotable arm member 16 in its closed and engaged position with the transverse member 18 as illustrated in FIGS. 1–3 and 8. Although a wide variety of different types of locking systems may be utilized selectively to lock the pivotable arm member 16 in its closed position such as a conventional key-lock system, for ease of use, it is preferred that a combination lock mechanism such as the combination lock system 24 be utilized to accomplish this task. As illustrated in FIGS. 1–8, the combination lock system 24 may include any plurality of tumblers 32 to establish a numerical sequence which would define an unlocked position whereby the pivotable arm member such as arm member 16 would be pivotally movable to its open position. The present plug locking device 10 may be provided with a selected numerical sequence for tumblers 32 to define an unlocked condition, or appropriate means may be associated with the plug locking device 10 for allowing a user to selectively set and change the open combination in the combination lock system 24. In either event, appropriate mechanisms such as pin members, slide members or other means are associated with tumblers 32 such that in its locked condition, pivotable arm member 16 is not movable to its open position, but instead, stays engaged with the free end portion 28 of transverse member 18 as previously explained. When the appropriate numerical sequence of numbers (open combination) is positioned within the plurality of tumblers 32, the locking mechanism is released and arm member 16 can be pivotally moved to its open position. It is recognized and anticipated that other locking mechanisms may likewise be utilized with the present invention.

In the particular embodiment of the present plug locking device 10 illustrated in FIGS. 1–8, the device 10 is provided with means for allowing a user to selectively set and randomly change at will the open combination associated with the combination lock system 24. One embodiment of a mechanism for allowing the open combination numerical sequence to be selectively changed includes use of the pin or button member 38 illustrated in FIG. 5, which member 38 is coupled to the combination lock system 24 in a conventional manner to allow the open combination to be changed. For example, the combination lock system 24 will be provided with a preset open combination such as 0000. When the tumblers 32 on the front side of the device 10 are moved to the open combination, that is, the numerical sequence 0000 is aligned with the open or set line position of the tumblers as indicated, for example, by the reference line 40 illustrated in FIGS. 1, 3 and 7, the pivotable arm 16 can be rotated to its open position. To change an existing open combination, leave the tumblers 32 at the open combination sequence aligned with the reference line 40; close the pivotable arm 16; and with the pivotable arm 16 in its closed position, push the pin or button member 38 in with a tool provided with the device 10, the tip of a ball point pen, or other similar instrument. With the pin or button member 38 held in its pushed-in position, reset the tumblers 32 to the new desired open combination numerical sequence starting with the tumbler 32 closest to the button member 38 or closest to the fixed or non-movable arm 14. Once the new numerical sequence has been set and displayed on the tumblers 32, release the button member 38 and the new desired open combination is now set and ready for use. Operation of the present plug locking device 10 is the same as previously explained except that the new open combination now triggers movement of the pivotable arm 16 between its closed and open positions. A new personal open combination numerical sequence may be set at the discretion of the user. It is recognized and anticipated that a wide variety of other means may also be used to selectively change the open combination associated with the combination lock system 24.

It is also important to note that transverse member 18 is sufficiently spaced inwardly from the terminal end portion 34 of each respective arm member as best illustrated in FIG. 3 such that rotation or other movement of the prongs associated with a particular electrical plug when engaged with the transverse member 18 as illustrated in FIG. 8 will not, in any position of rotation or other maneuverable orientation about member 18, expose the terminal end portions 36 of the prongs beyond the end portions 34 of the respective arm members 14 and 16. In other words, the distance D illustrated in FIG. 3 between the transverse member 18 and the terminal end portion 34 of each respective arm member 14 and 16 is greater than the distance P illustrated in FIG. 8 between the terminal end portion 36 of each plug prong and the transverse member 18. Still further, it is likewise important to note that the end portion 34 of each arm member 14 and 16 is likewise sized and dimensioned such that the terminal end portions 36 of the plug prongs will not extend beyond the periphery of the arm members 14 and 16 at any rotatable position or other maneuverable orientation when engaged with the transverse member 18. In the particular embodiment illustrated in FIGS. 1–8, the end portions of each arm member 14 and 16 are arcuate in shape. It is recognized and anticipated that the shape of the respective arm member end portions may vary widely and that such shape may take on a wide variety of different shapes so long as the terminal end portions 36 of a pair of prongs captured within the present plug locking device 10 cannot be rotated or otherwise maneuvered in any direction or into any orientation while engaged with the transverse member 18 so as to extend beyond the periphery of the arm members 14 and 16. This means that the distance or radius R illustrated in FIG. 4 is greater than the distance P illustrated in FIG. 8 at all positionable orientations of the plug prongs about transverse member 18. The very fact that the terminal end portions 36 of any pair of plug prongs engaged with the transverse member 18 will not be exposed beyond the periphery of the arm members 14 and 16 at any orientation provides an additional safety feature in that it is physically impossible for the end portions 36 of the plug prongs to be engaged in any manner whatsoever with an electrical outlet. This precludes the possibility of even a partial interaction between one or both prongs of a particular electrical plug and an electrical outlet thereby preventing the possibility of any electrical shock or other injury or damage to an unauthorized user of the device. Still further, the size and shape of the present plug locking device including transverse member 18 is such that the present device 10 is engageable with all standard two and three prong electrical plugs as illustrated in FIG. 8.

Thus, there has been shown and described a novel plug locking device for use to prevent the unauthorized use of electrically powered devices, which plug locking device fulfills all of the objects and advantages sought therefore. Many changes, modifications, variations and other uses and applications of the present plug locking device will, however, become apparent to those skilled in the art after considering this specification and the accompanying drawings. All such changes, modifications, variations and other uses and applications which do not depart from the spirit and scope of the present invention are deemed to be covered by the invention which is limited only by the claims which follow.

What is claimed is:

1. A locking device for use with an electrical plug having at least one prong associated therewith, the at least one prong having an aperture spaced from its terminal end portion, the locking device comprising:

a body member;

a pair of spaced arm members extending adjacent one side portion of said body member, each of said arm members having a terminal end portion;

an elongated member extending between said pair of arm members having a free end portion, said elongated member being sized and shaped for insertably receiving the aperture associated with the at least one prong and being positioned relative to the terminal end portions of said pair of arm members such that the terminal end portion of the at least one prong cannot be maneuvered into any orientation while engaged with said elongated member so as to extend beyond the terminal end portions of said pair of arm members; and one of said arm members being movable between a first position wherein sufficient space is provided for engaging the aperture of the at least one prong with the free end portion of said elongated member and a second position wherein the at least one prong cannot be disengaged from said elongated member, said pair of arm members being further sized and shaped such that the terminal end portion of the at least one prong cannot be maneuvered into any orientation while engaged with said elongated member so as to extend beyond the periphery of said pair of arm members.

2. The locking device defined in claim 1 wherein one of said arm members is fixedly attached to said body member.

3. The locking device defined in claim 1 wherein said elongated member is fixedly attached to one of said arm members.

4. The locking device defined in claim 1 including a locking mechanism for selectively holding said movable arm member in its second position.

5. The locking device defined in claim 4 wherein said locking mechanism is a combination lock system.

6. A locking device for preventing insertion of a male electrical plug into an electrical outlet, the plug having a pair of spaced prongs each defining an aperture spaced from its respective terminal end portion, the apertures having centers aligned along a common axis, the locking device comprising:

a body member;

a pair of spaced arm members extending adjacent one side portion of said body member defining a space therebetween, each of said arm members having a terminal end portion;

a transverse member extending between said pair of arm members having a free end portion, said transverse member being sized and shaped to be insertably received within the apertures associated with the pair of spaced prongs, said transverse member being spaced from the terminal end portions of said arm members such that the terminal end portions of the spaced prongs cannot be maneuvered into any orientation when engaged with said transverse member so as to extend beyond the terminal end portions of said arm members;

one of said arm members being pivotally movable between an open position wherein sufficient space is provided adjacent the free end portion of said transverse member for insertably positioning said transverse member within the apertures of the spaced prongs, and a closed position wherein said transverse member cannot be withdrawn from the apertures of the spaced prongs, said pair of arm members being sized and shaped such that the terminal end portions of the spaced prongs cannot be maneuvered into any orientation when engaged with said transverse member so as to extend beyond the periphery of said arm member; and a locking mechanism for selectively holding said movable arm member in its closed position.

7. The locking device defined in claim 6 wherein said locking mechanism is a combination lock system.

8. The locking device defined in claim 6 wherein said movable arm member is pivotally attached to said body member.

9. The locking device defined in claim 6 wherein said pivotally movable arm member includes a cavity, said cavity being adapted to receive the free end portion of said transverse member when said movable arm member is in its closed position.

10. The locking device defined in claim 6 wherein said other arm member is fixedly attached to said body member.

11. The locking device defined in claim 10 wherein said transverse member is fixedly attached to said other arm member.

12. A locking device for preventing insertion of a male electrical plug into an electrical outlet, the plug having a pair of spaced prongs each defining an aperture spaced from its respective terminal end portion, the apertures having centers aligned along a common axis, the locking device comprising:

a body member;

a pair of spaced arm members extending adjacent one side portion of said body member defining a space therebetween, each of said arm members having a terminal end portion;

a transverse member extending between said pair of arm members having a free end portion, said transverse member being sized and shaped to be insertably received within the apertures associated with the pair of spaced prongs;

one of said arm members being pivotally movable between an open position wherein sufficient space is provided adjacent the free end portion of said transverse member for insertably positioning said transverse member within the apertures of the spaced prongs, and a closed position wherein said transverse member cannot be withdrawn from the apertures of the spaced prongs, said pair of arm members being sized and shaped and said transverse member being positioned and located from the terminal end portions of said pair of arm members such that the terminal end portions of the spaced prongs cannot be maneuvered into any orientation when engaged with said transverse member so as to extend beyond the periphery of the arm members; and a locking mechanism for selectively holding said movable arm member in its closed position.

* * * * *

UNITED STATES PATENT AND TRADEMARK OFFICE

CERTIFICATE OF CORRECTION

PATENT NO. : 6,935,871 B2
DATED : August 30, 2005
INVENTOR(S) : Michael Maurer, Jr.

It is certified that error appears in the above-identified patent and that said Letters Patent is hereby corrected as shown below:

Column 1,
Line 27, delete “a re” and replace with -- are --.

Column 8,
Line 3, delete “device” and replace with -- member --.

Signed and Sealed this

First Day of November, 2005

JON W. DUDAS
*Director of the United States Patent and Trademark Office*